US009562397B2

(12) United States Patent
Rives

(10) Patent No.: US 9,562,397 B2
(45) Date of Patent: Feb. 7, 2017

(54) ADJUSTABLE BODY SUPPORTED CUTTER ARMS FOR UNDERREAMER

(75) Inventor: Allen Kent Rives, Cypress, TX (US)

(73) Assignee: Tiger 19 Partners, Ltd., New Braunfels, TX (US)

( * ) Notice: Subject to any disclaimer, the term of this patent is extended or adjusted under 35 U.S.C. 154(b) by 681 days.

(21) Appl. No.: 13/981,077

(22) PCT Filed: Feb. 24, 2011

(86) PCT No.: PCT/US2011/025982

§ 371 (c)(1),
(2), (4) Date: Jul. 22, 2013

(87) PCT Pub. No.: WO2012/115644

PCT Pub. Date: Aug. 30, 2012

(65) Prior Publication Data

US 2013/0299248 A1 Nov. 14, 2013

(51) Int. Cl.
*E21B 10/32* (2006.01)
*E21B 7/28* (2006.01)

(52) U.S. Cl.
CPC ..... *E21B 10/32* (2013.01); *E21B 7/28* (2013.01); *E21B 10/322* (2013.01); *E21B 10/327* (2013.01)

(58) Field of Classification Search
CPC ..... E21B 7/28; E21B 10/322; E21B 10/327; E21B 10/32
See application file for complete search history.

(56) References Cited

U.S. PATENT DOCUMENTS 3,749,187 A * 7/1973 Leathers ..... E21B 10/345 175/269
4,614,242 A * 9/1986 Rives ..... E21B 10/345 175/269
7,584,811 B2 * 9/2009 Fanuel ..... E21B 10/32 175/268

* cited by examiner

*Primary Examiner* — Yong-Suk (Philip) Ro
(74) *Attorney, Agent, or Firm* — David B. Dickinson

(57) ABSTRACT

An underreamer for connection with a rotary pipe string includes inner and outer body sections which form a body structure to provide a fluid flow path therethrough for communicating with piston and cylinder means formed between the body sections for receiving drilling fluid to effect telescopic movement between the body sections permitting engagement of cutter arms and support of said cutter arms on the outer body of the underreamer utilizing a slideable, non-pivoting stop block. Cutter arms are pivotally mounted on the inner body section and, upon engagement of the cutter arms to effect underreaming are fully supported on the outer body section thereby minimizing damage from vibration and repeated use on the threaded inner body sections.

6 Claims, 3 Drawing Sheets

ADJUSTABLE BODY SUPPORTED CUTTER ARMS FOR UNDERREAMER

CROSS-REFERENCE TO RELATED APPLICATIONS

This application incorporates U.S. Pat. No. 4,614,242 herein by reference as background information for this application.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION-BY-REFERENCE OF MATERIALS SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION (1) Field of Invention

This invention relates to a hole enlargement arrangement and method of use; more specifically to an underreamer that provides a cutter arm assembly supported, upon extension, by a slideable, non-pivoting stop block which passes all shocks absorbed by the cutter arm to the outer body of the tool.

(2) Description of Related Art including information disclosed under 37 CFR 1.97 and 1.98

Various types of hole enlargement arrangements have been heretofore employed and are currently in use. In the devices with which applicant is familiar, a body structure formed of inner and outer body sections has cutter arms pivotally secured on the outer body section and a piston and cylinder means defined between the inner and outer body sections receives hydraulic fluid to effect telescopic movement of the body sections in one relative direction whereupon a cam surface mechanically engages and forces cutter arms out to an underreaming or bore hole enlarging position. This arrangement is more clearly shown in U.S. Pat. No. 4,614,242, which is incorporated herein by reference as background information for this application.

After the underreaming operation is completed, the cutter arms of the prior art devices are generally then retracted by reducing the pump pressure and raising the operating string on which the body structure is supported so that the expanded or projecting arms engage the shoulder formed at the point of commencement of the underreaming. Continued raising of the operating string exerts a force on the extended cutter arms to move the arms inwardly to a retracted position relative to the body structure.

When the arms of the underreamer are extended during hole enlarging operations to underream or drill an enlarged portion in a bore hole, there are various forces that act upon the cutter arms, such as an upwardly directed force on the outer projecting end of the arm due to the weight of the operating string during underreaming reacting with the well bore.

In the prior art devices, these forces are transmitted from the cutter arms to the pivot arrangement of the cutter arms on the body structure and to the cam surface which is relied upon to move and maintain the cutter arms in an extended cutting position, then to the yoke and threads connecting the inner tube elements. These forces may be substantial and, in some instances, repeated use will damage or break components of the underreamer where the inner body was threaded to the yoke assembly. Wear from continued use of the device causes vibration of the arm and underreamer in extension, causing or accelerating further wear, damage or failure of these types of tools.

The present invention provides an arrangement that assists in overcoming the above problems by transferring all mechanical forces acting on the cutter arm to the slideable, non-pivoting stop block and the outer body. The solidity of the stop block seated against the outer body of the underreamer also provides additional strength to deformation from the lateral forces acting upon the underreamer in contact with the well bore. As an additional benefit, the improved underreamer arm assembly can retrofit an existing underreamer body with these new components.

The inner body structure and a cooperative support arrangement move the stop block and arms into position on the outer body section. This cooperative support to yoke arrangement moves the cutter arms to the extended cutter position. The cooperating support arrangement is relieved of supporting the extended arms. Because the stop block and outer body fully support and assist in distributing the loads and forces employed during the bore hole enlarging operation, the support provided by the stop block and outer body also increase the mechanical advantage tending to maintain the cutter arms in an expanded position during underreaming. The shape of the stop block accommodates a full metal-to-metal contact between the base of the cutter arm and outer body and thereby avoids passing these large shock loads on to the threaded or weaker internal components of the underreamer device.

BRIEF SUMMARY OF THE INVENTION

An improved underreamer cutter arm assembly provides a cutter arm with a lateral slot on at least one lateral side of the cutter arm and one or more cutter elements on a distal end of the cutter arm; a moveable yoke assembly engaging an interior surface of an underreamer pinned to a proximal end of the cutter arm, and a stop block slideably engaged on an interior surface of the underreamer positioned between the cutter arm and an outer surface of the underreamer; whereby the stop block abuts the outer body of the underreamer upon full extension of the cutter arm from the underreamer, transferring all mechanical forces acting on the cutter arm to the stop block and the outer body.

This improved cutter arm can support a variety of cutter means frequently used on underreamers in the art. For example, the cutter means can be either roller cone cutters, hardened cutter elements, such as tungsten carbide buttons, or polycrystalline diamond cutters (PDC) without deviating from the spirit or intent of this invention, positioned on the distal end of said arm, depending on the type of formation in which the tool is to be used.

The disclosed embodiment permits the assembly of an improved underreamer having a fluid flow path comprising a body structure including an inner and an outer telescopic body section having circumferentially spaced, longitudinal slots for receiving the cutter arms; one or more moveable cutter arms pivotally supported on a distal end of the inner telescopic body section; a yoke on the inner body section slideably engaging one or more stop blocks and pivotally connected to the one or more moveable cutter arms; longitudinally extending grooves on at least one lateral side of the one or more moveable cutter arms cooperatively engaged with a projection for selective movement of the cutter arms in the outer body section to pivotally support the cutter arms in the longitudinal slots of the outer body section; and, a fluid actuated piston to move the inner body section, moving the one or more cutter arms between the projections and the grooves to expand the cutter arms outwardly of the outer body section and to seat the stop block against the outer body.

This improved underreamer also thereby provides the additional feature permitting a plurality of field-replaceable stop blocks adjustably limiting the telescopic movement of the body sections, allowing a range of hole enlargement diameters that may be attained with the same underreamer body. The cutter arm provides the ability to interchange the stop block; lengthening the block to shorten the extension of the cutter arm from the lateral surface of the underreamer, or shortening the block to increase the extension of the cutter arm from the lateral surface of the underreamer.

The longitudinally extending grooves on at least one side of the cutter arms extend diagonally relative to the longitudinal axis of the cutter arms and, with a resilient member move the inner body section to retract the cutter arms in the longitudinal slots in the outer body section.

Other objects and advantages of the present invention will become apparent from a consideration of the following description and drawings.

DETAILED DESCRIPTION OF THE INVENTION

Figure 1:
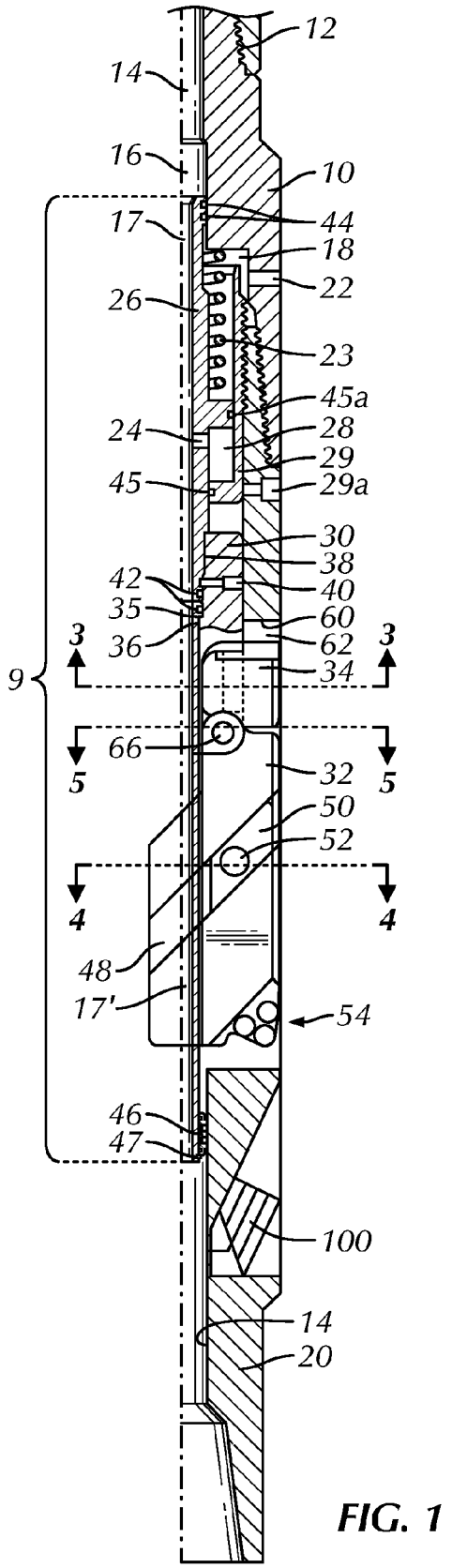
FIG. 1 is a longitudinal sectional view illustrating a preferred embodiment of the bore hole enlarger with the cutter arms in retracted position.
Figure 2:
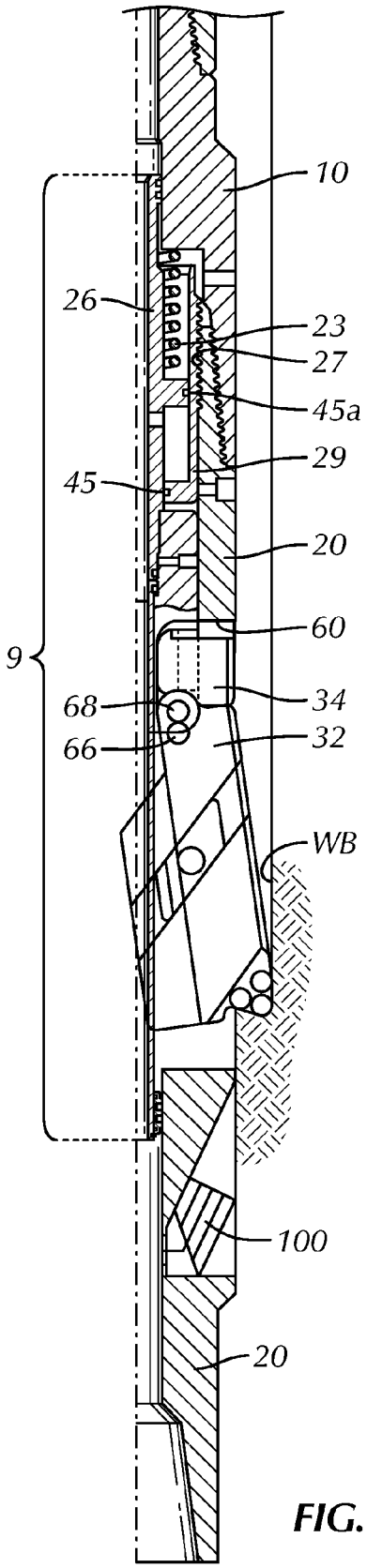
FIG. 2 is a sectional view of the tool with the cutter arm in the extended position.

FIG. 1 shows the underreamer of the present invention in the closed or relaxed position. FIG. 2 shows the underreamer of the present application in the energized position with the cutter arm engaging a well bore WB.

Directing our attention to the underreamer shown in FIG. 1, the upper tubular body 10 provides a bore 14 allowing hydraulic communication through the upper body 10 from a drillstring (not shown) which is threaded to the upper male threads 12 of upper body 10. Upper body 10 also provides a counterbore section 16 into which is fitted upper tube assembly 26 providing a set of hydraulic seals 44 to provide a dynamic seal on the tube in the counter-bored section 16 of the upper body 10.

FIG. 1 also shows a threaded connection means 12 on upper body 10 allowing connection in a drill string (not shown) and permitting the flow of drilling fluid through the upper tube assembly 26 through longitudinal passage 14. Upper body 10 is counter-bored 16 to provide a means for inner body, shown generally at 9, to move longitudinally in the upper body 10 and lower body 20 in the following manner.

The upper piston of the tube assembly 26 engages an interior wall of an annular sleeve 29 inserted in an upper threaded throat 27 of the lower body 20. This sleeve 29 portion is held in a fixed position in the lower body 20 by set screw 29*a*. Counterbore 16 also provides chamber 18 with fluid passage 22, enclosing a spring 23 which provides resistance to the extension movement of the inner body when pump pressure is increased and fills the space 28 through the port 24 to move the cutter arm 32 into engagement with the well bore for underreaming.

Tube assembly 26 provides a passage 24 to chamber 28 to provide hydraulic pressure from a longitudinal passage 14 to move the piston assembly connected to yoke 30 and cutter arm 32. Yoke 30 provides a rail permitting movement of stop block 34. Stop block 34 has a complementary slot for relative movement on yoke 30. Yoke 30 is threadedly connected to tube assembly 26 by threaded connection 38 and is prevented from loosening by set screw 40. Dynamic seals 42, 44, and 46 are provided between the hydraulically sealed tubes 26, 36 to seal the tube assembly within the assembled underreamer body 10, 20. The cutter arm assembly 32 has a slot 48 into which is assembled a cam 50 retained in the body by pin or other means 52 to thereby permit relative lateral cutter arm 32 movement thereby engaging the cutter elements 54 on a distal end outward of the body 20 on a wellbore (not shown in FIG. 1). Lower tube assembly 36 is seated on shoulder 35 onto which is placed upper tube 26 which are then affixed to the yoke assembly 30 by set screw 40 to prevent disengagement of the inner body assembly 9. Seal bushing assembly 46 is mounted in the distal end to support the dynamic sealing elements and is retained thereon by a snap ring 47 or other device, all in a manner well known in this art.

As further shown in FIG. 1, inner body 9 comprised of an assembly providing a bore 17 communicating from the interior diameter 14 of an underreamer, comprised of an upper body 10 connected to lower body 20, providing a jetting nozzle 100 in a manner well known in this art and providing hydraulic pressure on the drill bit or motor which are normally found on the distal end of the drill string.

FIG. 2 is another view of the improved underreamer of the present application showing the cutter arm in extension after pump pressure has moved the inner body up and caused each arm to move outwardly of the body. All of the structure shown in FIGS. 1 and 2 are described in U.S. Pat. No. 4,614,242, with the exception of the cooperating stop block 34 with the upper body 10 connected with lower body 20 to form the outer body of the underreamer. As shown in FIG.

2, an increase in pump pressure moves the piston arrangement, i.e. the top 26 of the inner body or tube assembly 9 providing a dynamic seal 45*a* between the outer diameter of the inner body 9 and the inner diameter of the sleeve portion 29, having lower seal 45.

As may be readily appreciated, increased pump pressure moves drilling mud from the inner longitudinal bore 17 through port 24 into the space 28 moving the piston upward and compressing resilient member 23. This action moves yoke 30 drawing the stop block 34 across the unencumbered space 62, as seen in FIG. 1, into engagement with the shoulder 60 of lower body 20 which together with upper body 10 forms the outer body of the underreamer. FIG. 2 also shows the relative movement of the pin 66 from the relaxed or unextended position and pin 68 of the extended position of the cutter arm 32 yoke assembly 30.

Figure 3:
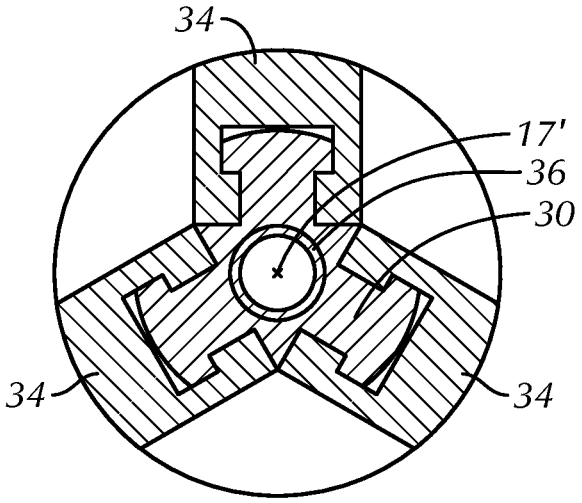
FIG. 3 is a sectional view on the line 3-3 of FIG. 1 to better illustrate certain structural details.

FIG. 3 is a cross-sectional view of the stop blocks 34, shown on FIG. 1 at line 3-3, showing lower tube 36 providing passage 17' and yoke 30 on which each stop block 34 is slideably engaged. FIG. 3 also more clearly shows the relative distribution of the stop block assemblies 34 on each rail of the yoke assembly 30.

Figure 4:
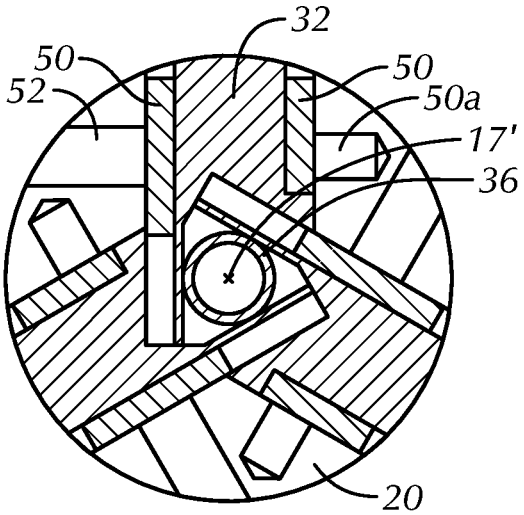
FIG. 4 is a sectional view on the line 4-4 of FIG. 1 to illustrate an embodiment of the cooperative means on the outer body section and the cutter arms.

FIG. 4 is a cross-sectional perspective through the view, shown in FIG. 1 at line 4-4, providing a view of the relative location of the cams 50 in grooves on each cutter arm 32 fitting around the central passage 36 to permit relative outward movement of the cutter arm assembly 32. Each side of the cam 50 is either provided with a pin 50*a* for engaging the underreamer body 20 or another method of fixing of said cam in said groove by means well known in the trade at 52.

Figure 5:
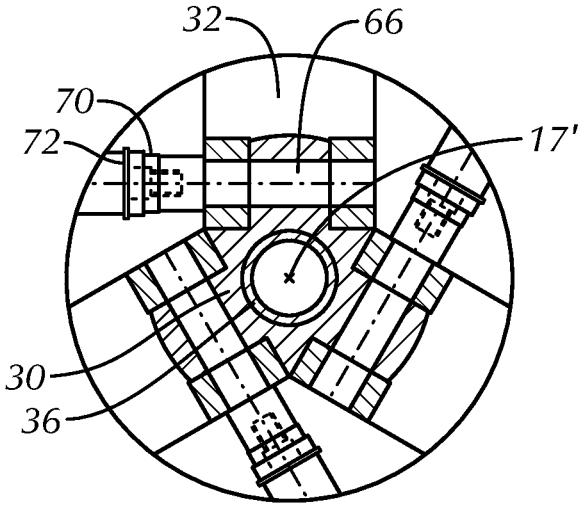
FIG. 5 is a sectional view on the line 5-5 of FIG. 1 to illustrate an embodiment of the cooperative means on the outer body section and the cutter arms.

FIG. 5 is a cross-sectional view of the pivot pin 66 and stop block 34 connection through the line 5-5 shown in FIG. 1 detailing the eccentric screws 70 which retain the pivot pins 66 in each cutter arm assembly 32. Each screw 70 is retained in the body with a snap ring 72. Tube 36 provides a fluid passageway 17' through the yoke assembly 30.

Figure 6:
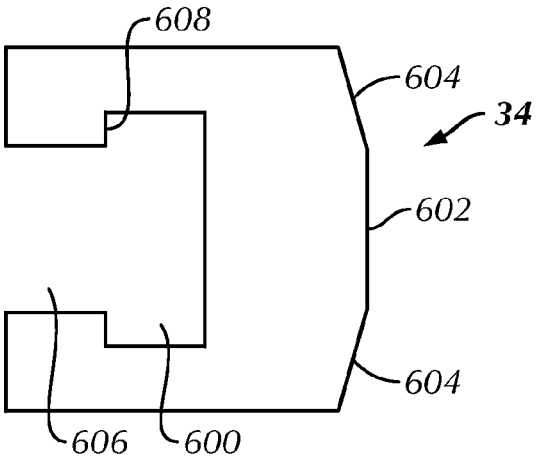
FIG. 6 is an end view of the stop block.

FIG. 6 is an end view of the stop block assembly 34 of the present embodiment showing the slot 600 running through the body 34 permitting slideable engagement with a rail on each portion of the yoke (not shown) and providing a shoulder 608 for engaging the yoke (not shown) and the stop block 34 in slideable engagement. The narrow portion of yoke 30 is affixed to the stop block 34 through the passageway 606. Stop block 34 also provides an upper surface 602 having a bevel 604 for conformity of the circular profile of the underreamer body 20.

Figure 7:
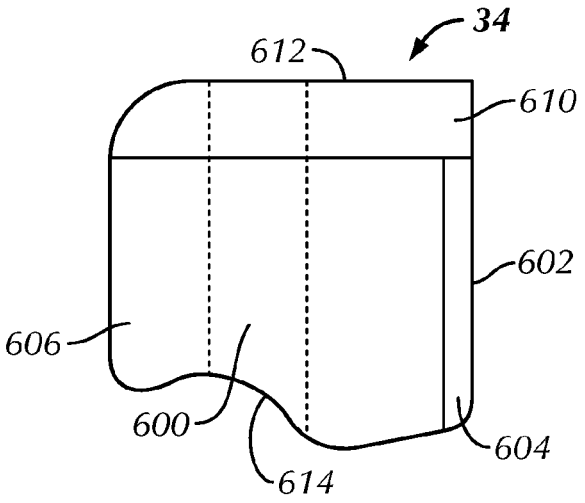
FIG. 7 is a perspective side view of the stop block showing the inner railed slot; and, FIG. 8 is a top perspective view of the stop block.

FIG. 7 is a side view of the stop block assembly 34 of the present embodiment showing the arcuate shaped lower end 614. The figure shows a side view of the stop block 34 having a lower surface profile 614 which accommodates the end of cutter arm (not shown) and which, upon movement of the stop block 34 in the lower body (not shown, but shown as 20 in FIGS. 1 and 2), engages the upper end 612 with the body (not shown, but shown as 20 in FIGS. 1 and 2). Lower profile 614 is designed to fully support the end of cutter arm (not shown, but more fully shown as 32 in FIGS. 1 and 2) in its extended position upon movement of the stop block 34 into contact with the outer body (not shown, but shown as 10 and 20 in FIGS. 1 and 2) at face 612 on the upper end of the stop block 34. Bevels 610 are provided on the upper end of stop block 34 to allow movement of the stop block 34 into full flush engagement with the upper body 20 shoulder at 60, as shown in FIGS. 1 and 2. The stop block is shaped to accommodate the pivot pin assembly (not shown in this view, but shown as 66 and 68 in FIGS. 1 and 2) and the movement of the cutter arm (not shown) outward from the body 20 to hold the cutter arm in full engagement with the well bore (not shown).

The flattened, shaved or beveled 604 exterior surface 602 allows the stop block 34 to conform with the circular profile of the underreamer body (not shown). The inner slot shown in the dashed area 600, 606 engages a rail (not shown) on the yoke assembly to slideably move and retain the stop block during operation within the underreamer body as previously described.

Figure 8:
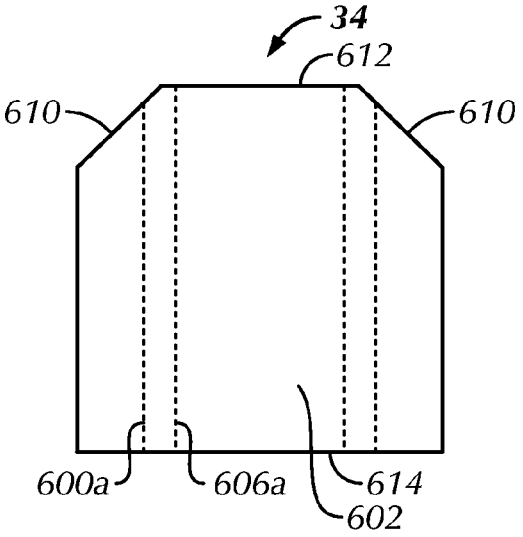

FIG. 8 is a top view of the stop block assembly 34 of the present embodiment showing in the dashed areas, the inner rail slot location 600*a*, 606*a* cut through the stop block 34 and slideably engaging the rail on the yoke assembly as previously described. FIG. 8 also shows the upper surface 602, the bevels 610 on the upper surface 612 as previously described and the lower surface 614 for engagement of the end of the cutter arms, all as previously described.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An improved underreamer cutter arm assembly comprising:

a cutter arm providing a lateral slot on at least one side of the cutter arm and one or more cutter elements on a distal end of the cutter arm;

a moveable yoke assembly engaging an interior surface of an underreamer comprised of an upper body connected to a lower body, pinned to a proximal end of the cutter arm, and a non-pivoting stop block slideably engaged on an interior surface of the underreamer comprised of an upper body connected to a lower body positioned between the cutter arm and an outer surface of the underreamer;

whereby the slideable, non-pivoting stop block abuts a shoulder of the underreamer upon full extension of the cutter arm from the underreamer transferring all mechanical forces acting on the cutter arm to the stop block and the underreamer.

2. The cutter arm of claim 1 wherein the slideable, non-pivoting stop block is elongated to shorten the extension of the cutter arm from a lateral surface of the underreamer comprised of an upper body connected to a lower body.

3. The cutter arm of claim 1 wherein the slideable, non-pivoting stop block is shortened to increase the extension of the cutter arm from a lateral surface of the underreamer comprised of an upper body connected to a lower body.

4. An improved underreamer, comprising: a fluid flow path through a body structure including an inner body moving telescopically within an outer body, comprised of an upper body connected to a lower body, section having circumferentially spaced, longitudinal slots for receiving cutter arms and one or more moveable cutter arms cooperatively engaged with a projection for selective movement of the cutter arms in the outer body section to pivotally support the cutter arms in the longitudinal slots of the outer body;

a yoke on the inner body section pivotally connected to the one or more moveable cutter arms and slideably engaging one or more field replaceable, slideable and non-pivoting stop blocks; and, a fluid actuated piston to move the inner body section, moving the one or more cutter arms between the cooperatively engaged projection and the grooves to expand the cutter arms outwardly of the outer body section and to seat the slideable, non-pivoting stop block against the telescopic outer body.

5. The improved underreamer of claim 4 wherein a plurality of field-replaceable stop blocks adjustably limit a telescopic movement of the body sections providing a range of hole enlargement diameters attainable with the underreamer.

6. A field-installable underreamer slideable, non-pivoting stop block slideably engaged between an internally sliding yoke and an articulated underreamer arm comprising:

an upper face adapted to fully engage an outer telescopic body of an underreamer comprised of an upper body and a lower body upon extension of an underreamer arm; and, an arcuate lower face adapted to fully engage a corresponding proximal edge surface of the underreamer arm upon movement of the underreamer arm by a yoke wherein force experienced by the cutter arm during underreaming is supported by the slideable, non-pivoting stop block in full engagement with the outer telescopic body of the underreamer.

* * * * *